US011846158B2

(12) United States Patent
Zhao

(10) Patent No.: US 11,846,158 B2
(45) Date of Patent: Dec. 19, 2023

(54) GRAPHENE HEATING THERMAL PRESERVATION SLEEVE FOR WELLHEAD OF OIL-GAS WELL

(71) Applicant: Anping Zhao, Beijing (CN)

(72) Inventor: Anping Zhao, Beijing (CN)

(73) Assignee: Anping Zhao

( * ) Notice: Subject to any disclaimer, the term of this patent is extended or adjusted under 35 U.S.C. 154(b) by 161 days.

(21) Appl. No.: 17/622,962

(22) PCT Filed: Jul. 6, 2020

(86) PCT No.: PCT/CN2020/000146
§ 371 (c)(1),
(2) Date: Dec. 27, 2021

(87) PCT Pub. No.: WO2021/004044
PCT Pub. Date: Jan. 14, 2021

(65) Prior Publication Data

US 2022/0243559 A1 Aug. 4, 2022

(30) Foreign Application Priority Data

Jul. 10, 2019 (CN) ..... 201910622266.2

(51) Int. Cl.
*E21B 33/03* (2006.01)
*E21B 36/04* (2006.01)
*H05B 3/14* (2006.01)

(52) U.S. Cl.
CPC ..... *E21B 36/04* (2013.01); *H05B 3/145* (2013.01); *H05B 2214/04* (2013.01)

(58) Field of Classification Search
CPC ..... E21B 33/03; E21B 36/00; E21B 33/005; E21B 33/04; E21B 36/04
See application file for complete search history.

(56) References Cited

U.S. PATENT DOCUMENTS

2014/0041851 A1* 2/2014 Wagner ..... E21B 36/003 166/57
2018/0338352 A1* 11/2018 Torita ..... H01C 17/06526
2023/0184060 A1* 6/2023 Malki ..... H05B 3/56 219/494

FOREIGN PATENT DOCUMENTS

CN 101086310 A 12/2007
CN 103202096 A 7/2013
(Continued)

OTHER PUBLICATIONS

International Search Report and Written Opinion dated Oct. 12, 2020 for corresponding International Application No. PCT/CN2020/000146; consisting of 13-pages.

*Primary Examiner* — Kipp C Wallace
(74) *Attorney, Agent, or Firm* — Christopher & Weisberg, P.A.

(57) ABSTRACT

Provided is a graphene heating thermal preservation sleeve for a wellhead of an oil-gas well in an oil field, the sleeve comprises a high-temperature-resistant thermal preservation layer (1), a graphene layer (2), an electrode layer (3), a high-temperature-resistant ceramic layer (4), a waterproof anti-static thermal preservation layer (5) and a housing (6) tightly attached together in sequence. Two parts of the heating thermal preservation sleeve are buckled together to enclose an oil-gas well wellhead apparatus (5) needing to be heated. When the electrode layers (3) at the two ends of the graphene layer (2) are electrified, under the action of an electric field, heat energy generated by violent friction and impact between carbon atoms of graphene is radiated out by means of far infrared rays with a wavelength in a range of 5-14 micrometers, for heating and thermal preservation of the oil-gas well wellhead apparatus (15) in an oil field.

10 Claims, 5 Drawing Sheets

(56) References Cited

FOREIGN PATENT DOCUMENTS

| | | | |
|---|---|---|---|
| CN | 203504776 | U | 3/2014 |
| CN | 105889707 | A | 8/2016 |
| CN | 206657682 | U | 11/2017 |
| CN | 207527145 | U | 6/2018 |
| CN | 208479963 | U | 2/2019 |
| CN | 109714837 | A | 5/2019 |
| CN | 109882683 | A | 6/2019 |
| CN | 110242251 | A | 9/2019 |
| CN | 209909407 | U | 1/2020 |
| CN | 211115919 | U | 7/2020 |

* cited by examiner

A direction

GRAPHENE HEATING THERMAL PRESERVATION SLEEVE FOR WELLHEAD OF OIL-GAS WELL

CROSS-REFERENCE TO RELATED APPLICATIONS:

This application is a submission under 35 U.S.C. § 371 for U.S. National Stage Patent Application of, and claims priority to, International Application Number PCT/CN2020/000146 entitled GRAPHENE HEATING THERMAL PRESERVATION SLEEVE FOR WELLHEAD OF OIL-GAS WELL filed Jul. 6, 2020, which is related to and claims priority to China Application No. 201910622266.2, filed Jul. 10, 2019, the entirety of all of which are incorporated herein by reference.

TECHNICAL FIELD

The present disclosure relates to a heating thermal preservation device for a wellhead of an oil-gas well, in particular to a graphene heating thermal preservation sleeve for a wellhead of an oil-gas well, which saves energy consumption, is convenient to mount and dismount and can effectively prevent an oil-gas well wellhead apparatus from being frozen.

BACKGROUND ART

At present, in well-known methods for preventing an oil-gas well wellhead apparatus from being frozen, an electric heating belt is wound on the oil-gas well wellhead apparatus for heating, and because the electric heating belt adopts a resistance heating principle for heating, the heating efficiency is low, high energy consumption and waste can be caused, and high production cost is generated; the electric heating belt is difficult to uniformly wind around each part of the wellhead equipment, so that the heating effect is very unbalanced; and the electric heating belt is frequently and repeatedly disassembled due to production, and the electric heating belt is easy to damage and lose after being disassembled, so that great waste is caused.

Related data at home and abroad are found out, most of all relevant heating equipment and technologies for preventing the oil-gas well wellhead apparatus in an oil field use the resistance heating principle for heating, such as electric heating belt heating equipment which is used in a large scale, and energy waste caused by the heating equipment is surprising; and in addition, a small part of methods for providing heat energy for heating by utilizing fossil fuel combustion are rarely adopted due to complex schemes and low heating efficiency.

SUMMARY

In order to overcome the defect that heating equipment adopting a resistance heating principle solves the problem that energy consumption is seriously wasted due to low heating efficiency when an oil-gas well wellhead apparatus in an oil field is frozen, the present disclosure provides a graphene heating thermal preservation sleeve for a wellhead of an oil-gas well in an oil field taking graphene as a heating source. The problem that the oil-gas well wellhead apparatus in an oil field is frozen is solved by utilizing the principle that graphene generates far infrared radiation under the action of an electric field.

Through the technical scheme, graphene heating thermal preservation sleeve for a wellhead of an oil-gas well provided by the present disclosure comprises a high-temperature-resistant thermal preservation layer approaching the outer wall of the oil-gas well wellhead apparatus in an oil field, a graphene layer, electrode layers, a high-temperature-resistant ceramic layer, a waterproof anti-static thermal preservation layer and a housing which are attached together in sequence. The graphene heating thermal preservation sleeve for a wellhead of an oil-gas well in an oil field is composed of two parts, after the two parts of the heating thermal preservation sleeve for a wellhead of an oil-gas well in an oil field are buckled together, wellhead equipment needing to be heated of an oil-gas well can be wrapped in the heating thermal preservation sleeve for a wellhead of an oil-gas well. When the electrode layers at the two ends of the graphene layer are electrified, under the action of the electric field, heat energy generated by violent friction and impact between carbon atoms of graphene is uniformly radiated through far infrared rays with the wave length of 5-14 micrometers in a planar manner, heat can be provided in a balanced manner, the temperature can be controlled by a temperature controller, the effective total conversion rate of electric heat energy reaches 99% or above, the heating thermal preservation requirement of the wellhead of the oil-gas well in an oil field are effectively met, and the effect of saving energy consumption is achieved.

The graphene heating thermal preservation sleeve has the advantages that a heating mode of taking graphene as a heating source is adopted, the heating thermal preservation requirement of the wellhead of the oil-gas well in an oil field is effectively met, energy consumption is reduced, mounting and dismounting are convenient, and the maintenance cost is low.

Reference signs: 1, high-temperature-resistant thermal preservation layer; 2, graphene layer; 3, electrode layer; 4, high-temperature-resistant ceramic layer; 5, waterproof anti-static thermal preservation layer; 6, housing; 7, sealing cover; 8, hasp; 9, way cock and gasket; 10, sealing ring; 11, sliding block; 12, sliding groove; 13, sliding block sealing groove; 14, sliding block hasp; 15, oil-gas well wellhead apparatus; 16, electric wire; 17, explosion-proof temperature controller; 18, temperature sensing probe; 19, power supply; and 20, valve handle.

DETAILED DESCRIPTION OF THE EMBODIMENTS

The present invention is further described in conjunction with the following attached figures and embodiment of the present disclosure.

EMBODIMENT

Figure 2:
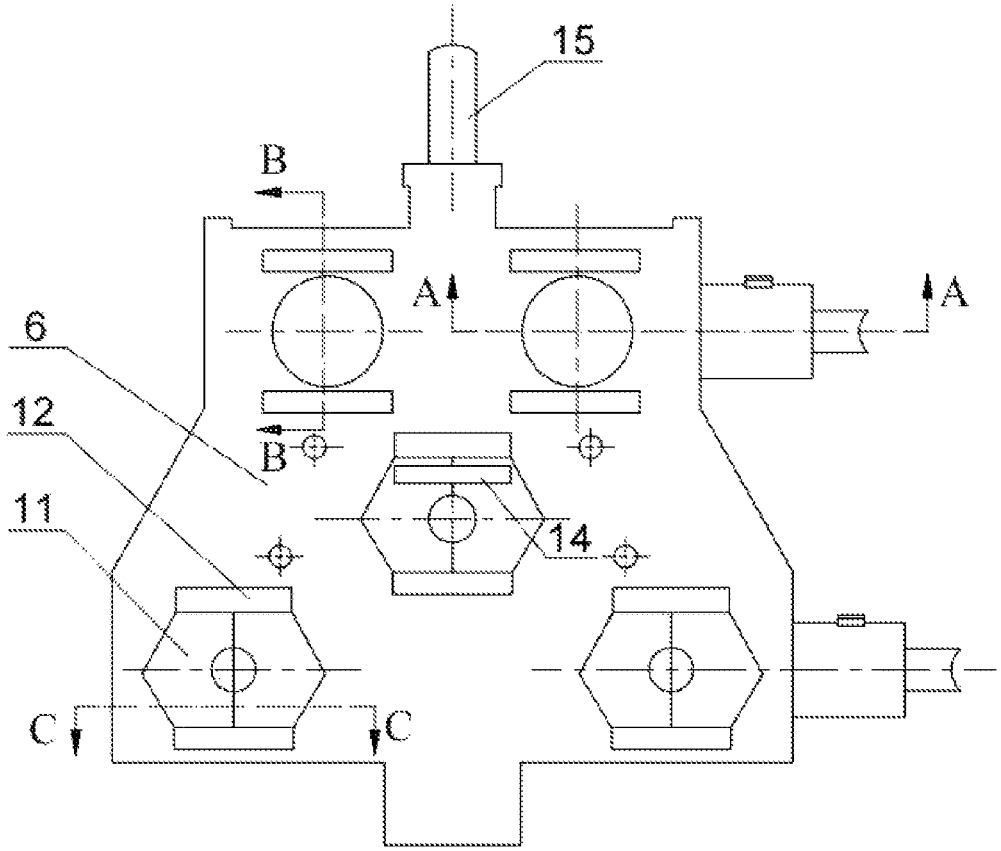
FIG. 2 is a schematic diagram of a graphene heating thermal preservation sleeve for a wellhead of an oil-gas well seen from one side of a valve handle in the embodiment of the present disclosure, wherein a sliding block (11) and a sliding block hasp (14) are omitted from the positions of two valve handles at the upper positions, and parts which can be seen from two valve handle through holes are also omitted; a sliding block (11) and a sliding block hasp (14) are installed at the position of one valve handle at the middle position; and sliding block hasps (14) are omitted from the positions of two valve handles at the lower position.

As shown in FIG. 2, two parts constituting a graphene heating thermal preservation sleeve for a wellhead of an oil-gas well can be easily installed together, particularly for the part of the graphene heating thermal preservation sleeve for a wellhead of an oil-gas well installed from one side of a valve handle. Before a sliding block (11) is not installed, five valve handles penetrate through corresponding valve handle through holes to be buckled with the other part, and then sliding blocks (11) and sliding block hasps (14) corresponding to the positions of the five valve handles are installed, so that installation is convenient, and the requirement for heat insulation is met.

Figure 3:
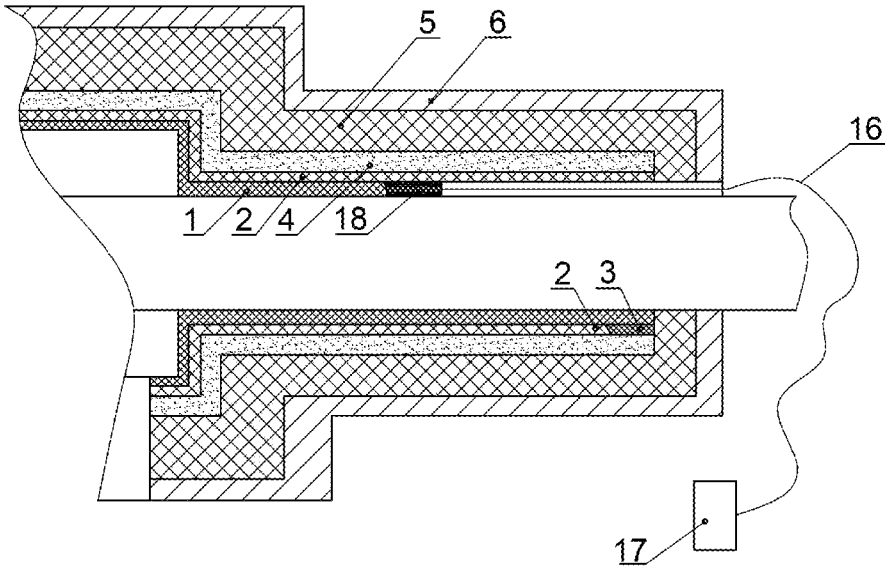
FIG. 3 is a relative position schematic diagram of constituent materials a graphene heating thermal preservation sleeve for a wellhead of an oil-gas well in an oil field in the embodiment of the present disclosure, and other parts except for a cross-sectional view and an oil-gas well wellhead apparatus (15) are omitted from the A-direction view.
Figure 4:
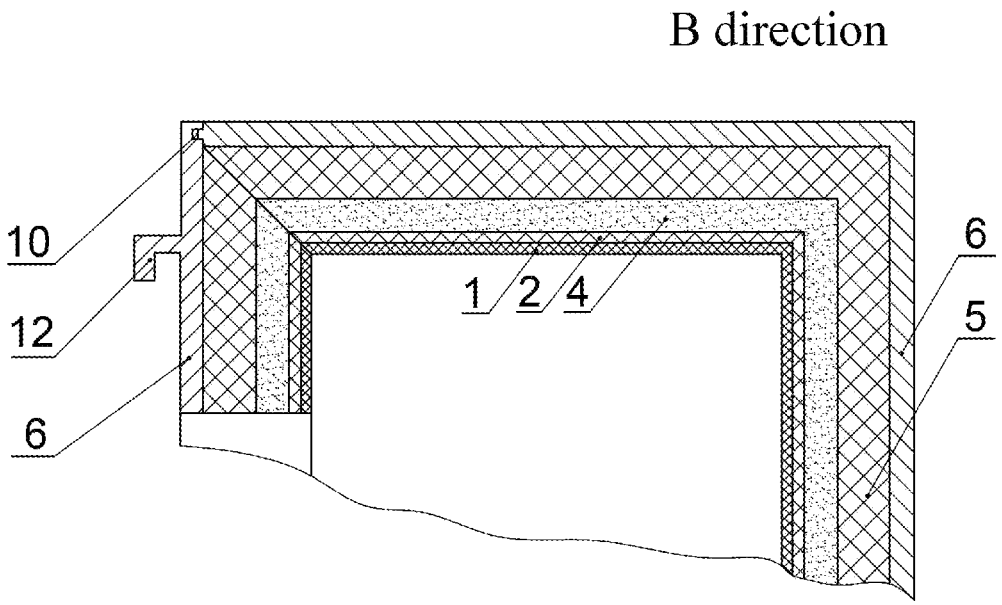
FIG. 4 is a schematic diagram of a sealing groove in the housing junction surface of the two parts of the heating thermal preservation sleeve for a wellhead of an oil-gas well in the embodiment of the present disclosure, and other parts except for a profile view are omitted in the B-direction view.

As shown in FIG. 3 and FIG. 4, a high-temperature-resistant thermal preservation layer (1), a graphene layer (2), electrode layers (3), a high-temperature-resistant ceramic layer (4), a waterproof anti-static thermal preservation layer (5) and a housing (6) which constitute the graphene heating thermal preservation sleeve for a wellhead of an oil-gas well are sequentially attached together from inside to outside.

As shown in FIG. 3, a temperature sensing probe (18) is tightly attached to the surface of oil-gas well wellhead apparatus (15).

As shown in FIG. 4, the structure of a sealing groove (10) of the housing junction surface of two parts of the graphene heating thermal preservation sleeve for a wellhead of an oil-gas well is shown.

Figure 5:
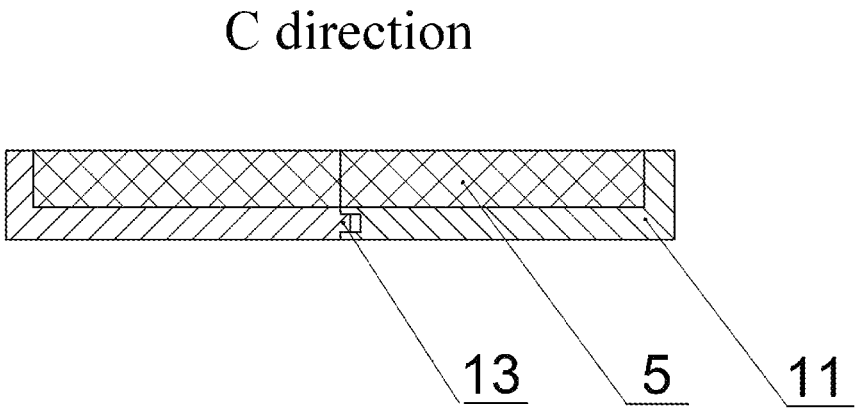
FIG. 5 is a schematic diagram of a sliding block sealing groove of the graphene heating thermal preservation sleeve for a wellhead of an oil-gas well in the embodiment of the present disclosure, and other parts except for a profile view of a sliding block (11) are omitted in the C-direction view.

As shown in FIG. 5, the structure of a sliding block sealing groove (13) of the graphene heating thermal preservation sleeve for a wellhead of an oil-gas well is shown.

Figure 1:
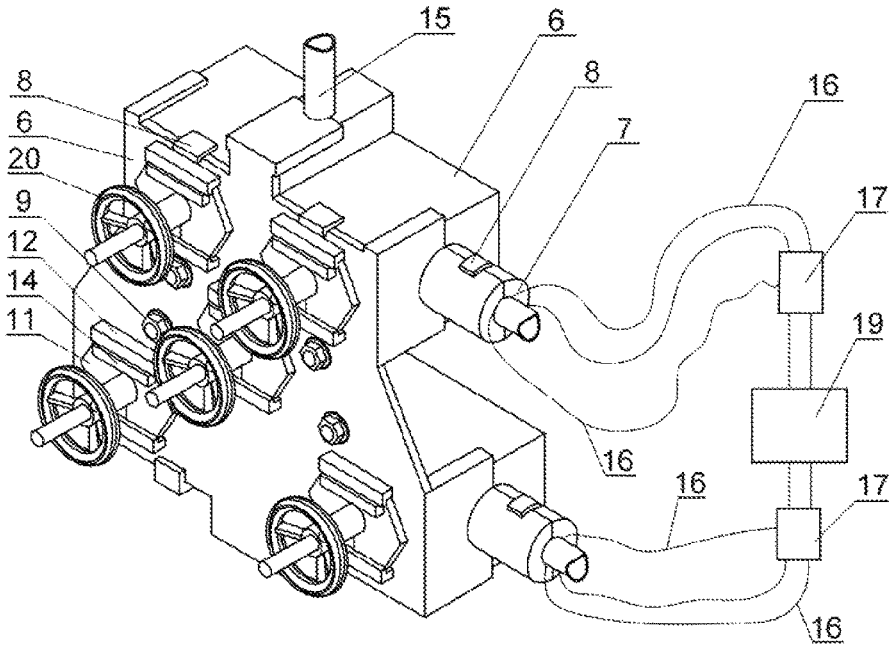
FIG. 1 is an overall schematic diagram of the embodiment in the present disclosure.

As shown in FIG. 1, the relative position of a sealing cover (7) on the graphene heating thermal preservation sleeve for a wellhead of an oil-gas well is shown.

When the electrode layers (3) at the two ends of the graphene layer (2) are connected with a power supply (19), under the action of an electric field, heat energy continuously generated by violent friction and impact between carbon atoms of the graphene layer (2) is uniformly radiated in a planar manner through far infrared rays with the wavelength of 5-14 microns, and the heat energy is directly transmitted to the outer surface of the oil-gas well wellhead apparatus (15), so that the temperature of the oil-gas well wellhead apparatus (15) is continuously increased from outside to inside, and heat lost due to outward dissipation can be reduced due to the heat insulation effect of the waterproof anti-static thermal preservation layer (5) and the housing (6) wrapping the outer side of the high-temperature-resistant ceramic layer (4). The temperature sensing probe (18) continuously transmits temperature data of the outer surface of the oil-gas well wellhead apparatus (15) to an explosion-proof temperature controller (17), and when the temperature of the outer surface of the oil-gas well wellhead apparatus (15) reaches the temperature preset for the explosion-proof temperature controller (17), the explosion-proof temperature controller (17) automatically disconnects a circuit connected with the electrode layers (3). At the moment, the graphene layer (2) stops radiating far infrared rays, the temperature of the outer surface of the oil-gas well wellhead apparatus (15) begins to drop, and when the explosion-proof temperature controller (17) detects that the temperature of the outer surface of the oil-gas well wellhead apparatus (15) is lower than the temperature preset for the explosion-proof temperature controller (17) through the temperature sensing probe (18), the explosion-proof temperature controller (17) automatically connects the circuit connected with the electrode layers (3); and the graphene layer (2) starts to radiate far infrared rays to heat the oil-gas well wellhead apparatus (15) under the action of the electric field. The processes are repeated and work uninterruptedly, so that the heating thermal preservation requirement of the oil-gas well wellhead apparatus is effectively met, and the effect of saving energy consumption is achieved.

What is claimed is:

1. A gra phene heating thermal preservation sleeve for a wellhead of an oil-gas well, comprising:

a high-temperature-resistant thermal preservation layer;

a heating layer;

electrode layers;

a waterproof anti-static thermal preservation layer; and a housing, wherein the heating layer is a graphene layer and the graphene heating thermal preservation sleeve is configured to cover and heat at least a majority of the wellhead when in use.

2. The graphene heating thermal preservation sleeve for the wellhead of the oil-gas well of claim 1, further comprising:

a high-temperature-resistant ceramic layer;

wherein the high-temperature-resistant thermal preservation layer, the gra phene layer, the electrode layers, the high-temperature-resistant ceramic layer, the waterproof anti-static thermal preservation layer and the housing are attached together in sequence.

3. The graphene heating thermal preservation sleeve for the wellhead of the oil-gas well of claim 1, wherein the heating thermal preservation sleeve is composed of two parts, and after the two parts of the heating thermal preservation sleeve for the wellhead of the oil-gas well are buckled together, the wellhead can be wrapped in the heating thermal preservation sleeve.

4. The graphene heating thermal preservation sleeve for a wellhead of an oil-gas well according to claim 2, wherein the heating thermal preservation sleeve is composed of two parts, and after the two parts of the heating thermal preservation sleeve for a wellhead of an oil-gas well are buckled together, the wellhead can be wrapped in the heating thermal preservation sleeve.

5. The graphene heating thermal preservation sleeve for the wellhead of the oil-gas well of claim 3, wherein five or more than five round holes allow valve handles of the oil-gas well wellhead apparatus to penetrate therethrough, a pair of sliding grooves are symmetrically distributed horizontally on each side of each round hole, two symmetrical sliding blocks are installed horizontally in each pair of sliding grooves and a semicircular hole is formed in each sliding block; the two sliding blocks are fixed together through a sliding block hasp; and a sliding block sealing groove is formed in a joint surface of the two sliding blocks.

6. The graphene heating thermal preservation sleeve for a wellhead of an oil- gas well according to claim 4, wherein five or more than five round holes allow valve handles of the oil-gas well wellhead apparatus to penetrate therethrough, a pair of sliding grooves are symmetrically distributed horizontally on each side of each round hole, two symmetrical sliding blocks are installed horizontally in each pair of sliding grooves and a semicircular hole is formed in each sliding block; the two sliding blocks are fixed together through a sliding block hasp; and a sliding block sealing groove is formed in a joint surface of the two sliding blocks.

7. The graphene heating thermal preservation sleeve for the wellhead of the oil-gas well of claim 3, wherein the two parts of the heating thermal preservation sleeve for the wellhead of an oil-gas well are buckled through two or more than two hasps; and corresponding sealing grooves are formed in a housing junction surface of the two parts of the heating thermal preservation sleeve for the wellhead of the oil-gas well.

8. The graphene heating thermal preservation sleeve for the wellhead of the oil-gas well of claim 4, wherein the two parts of the heating thermal preservation sleeve for the wellhead of an oil-gas well are buckled through two or more than two hasps; and corresponding sealing grooves are formed in a housing junction surface of the two parts of the heating thermal preservation sleeve for the wellhead of the oil-gas well.

9. The gra phene heating thermal preservation sleeve for the wellhead of the oil-gas well of claim 3, wherein a semicircular sealing cover perpendicular to an axis of the oil-gas well wellhead apparatus in an oil field is arranged at an end of each part of the graphene heating thermal preservation sleeve for the wellhead of the oil-gas well, a semicircular hole is formed in a circle center of each semicircular sealing cover, and an inner side of the sealing cover is covered with the waterproof anti-static thermal preservation layer.

10. The graphene heating thermal preservation sleeve for the wellhead of the oil-gas well of claim 4, wherein a semicircular sealing cover perpendicular to an axis of the oil-gas well wellhead apparatus in an oil field is arranged at an end of each part of the graphene heating thermal preservation sleeve for the wellhead of the oil-gas well, a semicircular hole is formed in a circle center of each semicircular sealing cover, and an inner side of the sealing cover is covered with the waterproof anti-static thermal preservation layer.

* * * * *